United States Patent [19]

Grosjean

[11] Patent Number: 5,077,711

[45] Date of Patent: Dec. 31, 1991

[54] CAPPED WATCH CASE

[75] Inventor: Laurent Grosjean, Neuchâtel, Switzerland

[73] Assignee: ETA SA Fabriques d'Ebauches, Switzerland

[21] Appl. No.: 666,937

[22] Filed: Mar. 11, 1991

Related U.S. Application Data

[62] Division of Ser. No. 327,053, Mar. 22, 1989.

[30] Foreign Application Priority Data

Mar. 23, 1988 [CH] Switzerland ..... 01096/88

[51] Int. Cl.[5] ..... G04B 37/00; A44C 5/00

[52] U.S. Cl. ..... 368/281; 368/294

[58] Field of Search ..... 368/280–282, 368/294–296, 300–327

[56] References Cited

U.S. PATENT DOCUMENTS

| | | | |
|---|---|---|---|
| 4,474,482 | 10/1984 | Gogniat | 368/294 |
| 4,648,722 | 3/1987 | Mock et al. | 368/294 |
| 4,831,606 | 5/1989 | Aellen | 368/282 |
| 4,993,007 | 2/1991 | Meister | 368/294 |
| 4,999,823 | 3/1991 | Grosjean | 368/294 |

*Primary Examiner*—Bernard Roskoski

*Attorney, Agent, or Firm*—Sughrue, Mion, Zinn, Macpeak & Seas

[57] ABSTRACT

The watch case comprises a middle cum bezel unit (14,16), a glass (18) secured to the unit and a bell-shaped cap (20). The glass (18) is formed with a heel (28) extending radially towards the periphery of the case. The glass (18) further defines with the bezel-forming portion (16) of the unit a groove (30) by means of which the cap (20) is secured and positioned.

2 Claims, 2 Drawing Sheets

CAPPED WATCH CASE

This is a divisional of application Ser. No. 07/327,053, filed Mar. 22, 1989.

BACKGROUND OF THE INVENTION

This invention relates to watch cases and more particularly to watch cases comprising a middle cum bezel unit, a glass secured to the middle cum bezel unit and a dish-shaped cap. The cap is provided with a bottom opening and a top opening. Such cases are known. Thus, British patent specification 102641 describes a case that is fitted with a cap covering the middle and that has a pair of wristlet-fastening loops. The cap is secured to the remainder of the case by engaging portions of the wristlet in the loops. A similar arrangement is described in German patent specification 1099773.

The drawbacks of such cases cause them to be unattractive. Because the cap is not rigidly and solidly secured, it is liable to move slightly on the middle. More importantly, the danger of the cap being pulled off cannot fully be eliminated. Also, because the cap is fitted after the glass has been assembled with the remainder of the case, it is virtually impossible to avoid having a gap between the glass and the cap, something that is not only inaesthetic but also forms a space into which foreign matter can penetrate while the watch is being worn. This gap further increases the danger of catching. As a result, a watch thus constructed, soon becomes unattractive or worse.

SUMMARY OF THE INVENTION

The object of the invention is to cure these drawbacks. More specifically, the case as claimed enables the cap to be secured to the middle cum bezel unit in a particularly rigid manner, the middle cum bezel unit, the glass and the cap together forming a solid and hence durable whole, and no longer an assemblage that gives a cheap case an appearance that rapidly becomes unsightly.

BRIEF DESCRIPTION OF THE DRAWINGS

The invention will be better understood on reading the following description, with reference to the drawings, in which.

DETAILED DESCRIPTION

Figure 1:
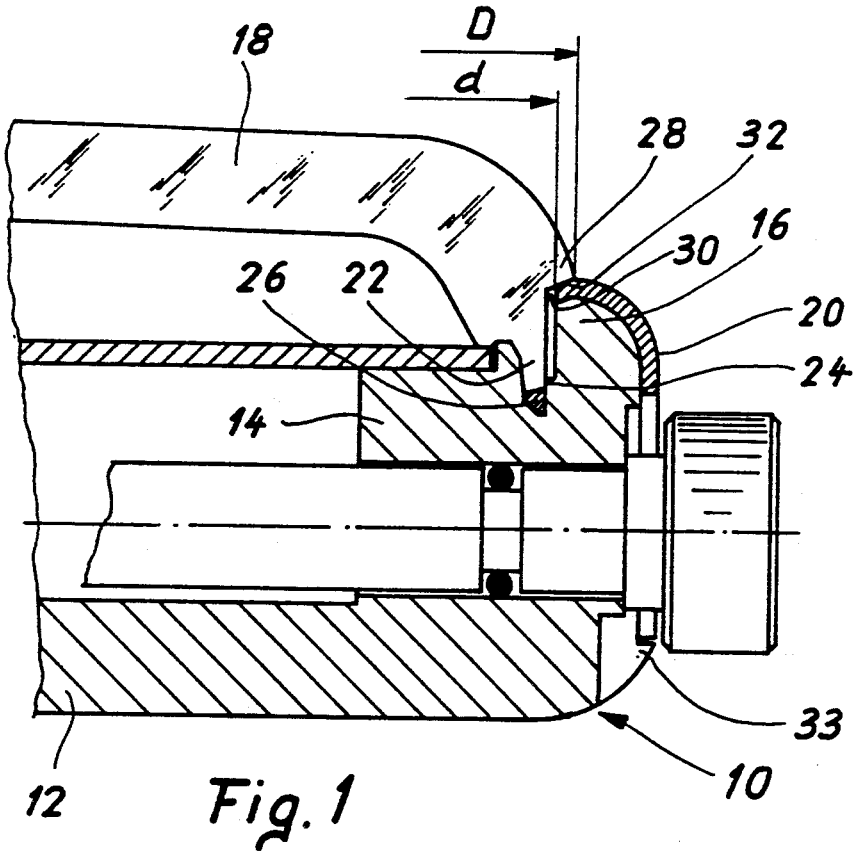
FIGS. 1 and 2 are each an approximately half cross-sectional view of a symmetrical case according to a first form of embodiment of the invention, the half sections extending respectively through 3 o'clock and 6 o'clock.
Figure 2:
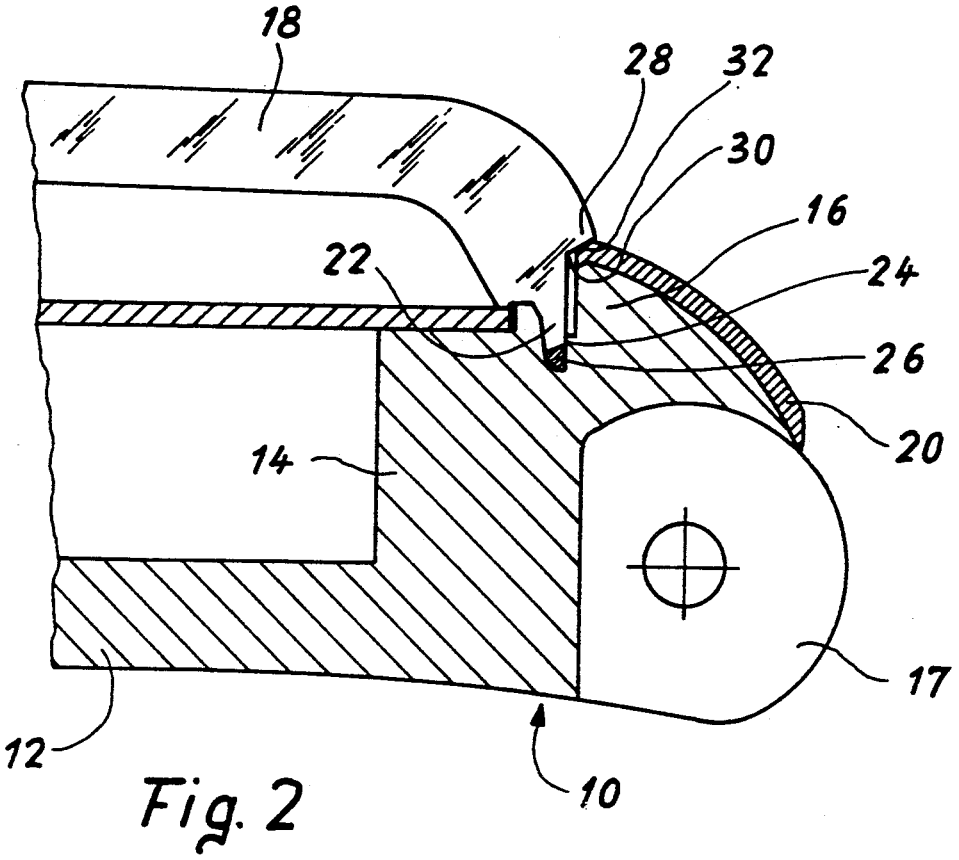

The case shown in FIGS. 1 and 2 comprises a part or casebond-bezel unit 10 of organic material, that simultaneously forms a back 12, a middle 14, a bezel 16 and outwardly extending spaced lugs 17 for securing a wristlet to opposite ends of the part 10 of the case. The case further comprises a glass 18, a dial 19 and a cap 20. Glass 18 and part 10 are made of materials that can be bonded to one another. Part 10 may for instance be made of one of the materials commonly referred to as ABS, ASA or SAN. These materials respectively correspond to an acryl butadiene styrene, an acryl styrene acryl ester and styrene acrylonitrile. In this event, the glass is made of a transparent acrylic resin (PMMA) commonly designated by the trade mark "Plexiglas". Glass 18 has a lip 22 of cylindrical shape that is engaged in a groove 24 in the middle-forming portion 14. The tip of lip 22 and the bottom of groove 24 together form an annulus 26, made up of a blend of the materials forming glass 18 and part 10. Annulus 26 is produced during ultrasonic bonding of glass 18 to part 10, which causes the materials of the tip of lip 22 and of the bottom of groove 24 to fuse. Such a process is in particular described in Swiss patent specification 650894 (corresponding to U.S. Pat. No. 4,558,957 having the same Assignee as this application) and is known to the man of the art. It will therefore not be described in detail here.

Glass 18 also has an outer heel 28 that extends radially above bezel-forming portion 16 of part 10.

More particularly, outer heel 28 and bezel-forming portion 16 define an annular groove 30 whose bottom and upper side are respectively defined by the body of glass 18 and by outer heel 28 while the lower side is defined by the upper surface of bezel 16.

Cap 20 is of metal, e.g. stainless steel or aluminium. It has a generally bell-like shape (to match the curved shape of the bezel-forming portion 16 whose outwardly extending end portions 16*a* form cover wall portions which cover the spaces between the lugs 17) with, in its upper portion, a substantially cylindrical opening having a diameter d less than diameter D of the glass and in particular of its heel-forming portion 28. The thickness of cap 20 lies between about 0.2 and 0.4 mm. The difference between D and d is of the order of 0.5 to 1 mm.

The top edge 32 of cap 20 is rigidly wedged between outer heel 28 and bezel 16, thereby positioning cap 20 axially and radially over the end portions 16*a* and the side portions 16*b* of the part 10. Middle-forming portion 14 has an annular inner shoulder portion which is surrounded by rim portion 21 integral with portion 14. Glass 18 also has an inner annular heel 29 defining with the shoulder portion and rim portion 21 another groove 23 in which the outer edge 25 of dial 19 is held, whereby both cap 20 and dial 19 are maintained and clamped in place by securing of glass 18 to the part 10. Further, as the outer shape of middle 14 is not defined by a surface of revolution, because in particular of lugs 17, cap 20 is also positioned angularly. In this way, part 10, glass 18, dial 19 and cap 20 together form a whole that is rigidly assembled in a manner that cannot be dismantled.

Furthermore, the cap has side portions 20*a* and end portions 20*b* respectively overlaying the side walls 10*a* of part 10 and the cover wall portions 16*a*. The end portions 20*b* extend outwardly and downwardly over a vertical distance D1 which allows the wristlet to be attached to the lugs 17, the distance D1 being less the vertical distance D2 over which the side portions 20*a* extend downwardly and outwardly over the side walls 10*a*.

Figure 3:
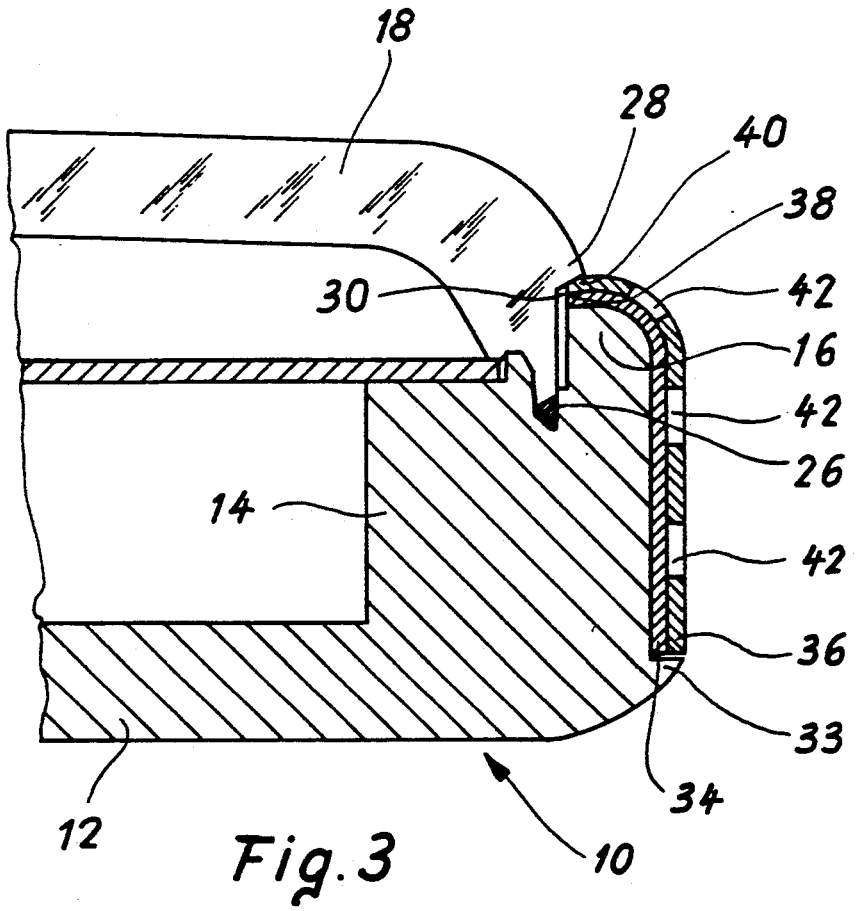
FIG. 3 is an approximately half cross-sectional view extending through 9 o'clock, of a symmetrical second form of embodiment of the invention.

In the arrangement described with reference to FIGS. 1 and 2 the case is provided with a single cap. It could of course have an additional cap, sandwiched between the outer cap and the middle, as shown in FIG. 3. In this figure may be seen part 10 with the portions that form back 12, middle 14, dial 19 and bezel 16, along with glass 18 and its heels 28 and 29 that define grooves 30 and 23 in conjunction with bezel 16, and projection 33.

This case is fitted with a pair of caps 34 and 36, both having a bell-like shape, with one, 34, nesting inside the other, 36.

Caps 34 and 36 respectively have an upper edge 38, 40. Both these edges are engaged in groove 30. Caps 34 and 36 are thus positioned axially and radially. Angular positioning is provided by the shape of middle 14 which, because in particular of lugs 17, has a shape other than that of a figure of revolution.

Outer cap 36 is formed with cut-outs 42 through which the sandwiched cap 34 is visible.

If the two caps are made of materials of different colour or appearance, original aesthetic effects can be achieved.

It is also possible to use caps of stainless steel, one polished, the other sand-blasted. If the caps were made of brass, one could be gilted and the other rhodium-plated. By varying the shape of the cut-outs and the appearance of the caps, it is possible to produce numerous variants.

Other forms of embodiment not shown could also be envisaged. For instance, the cap or caps could have cut-outs through which the sub-jacent middle can be seen.

It is also possible to provide recesses in the middle in which decorative pieces, e.g. stones, are positioned. They are held in place by the cap which is formed with openings whose edges bear on the peripheries of the stones.

Rather than being bonded, the glass could also be stuck. Sticking can also be resorted to improve the fixing of the cap to the middle and/or of the two overlaid caps.

In each of these examples are to be found the essential advantages of the cases according to the invention, i.e. a solidly secured cap with virtually no danger of catching and the absence of any gap between the glass and the cap.

What is claimed is:

1. A method for securing metal cap means (20) on the caseband bezel unit (10) of a watch case comprising the steps of:

providing a caseband-bezel unit (10) of a thermoplastic material, having integrally formed a back (12), a middle (14), a bezel (16), outwardly extending lugs (17) defining between them a space for attaching a wristlet to opposite ends of said caseband, cover wall portions **(16*a*) covering said spaces between said lugs (17), said cover wall portions (16*a*) extenting outwardly from the opposite ends of said caseband-bezel unit (10) and side walls (10*a*), the middle (14) presenting a groove (24), providing metal cap means (20) having a top opening surrounded by the top edge (32) of said cap, side portions (20*a*) and end portions (20*b*) overlaying side walls (10*a*) and coverwall portions (16*a*) of said caseband respectively, placing said metal cap means (20) on said caseband bezel unit (10) in order to match the shape of said caseband-bezel unit (10), providing a glass (18) of a material that can be bonded to the material of the caseband-bezel unit (10), said glass comprising a peripherical axially extending lip (22) and an outer heel (28) extending radially towards its periphery, placing said glass (18) on said caseband-bezel unit (10) covered with said cap means (20) such that the lip (22) is engaged in the groove (24) of said caseband-bezel unit (10) and the outer heel (28) defines with the bezel (16) a groove (30) in which the top edge (32) of said cap (20) is held and sandwiched for positioning said cap axially and radially, bonding said glass (18) to the caseband-bezel unit (10) by ultrasonic energy to form an annulus (26), made up of a blend of the materials forming said glass (18) and said unit (10)**.

2. A method for securing metal cap means (20) on the caseband bezel unit (10) of a watch comprising the steps of:

providing a caseband-bezel unit (10) of a thermoplastic material, having integrally formed a back (12), a middle (14), a bezel (16), outwardly extending lugs (17) defining between them a space for attaching a wristlet to opposite ends of said caseband, said caseband further comprising cover wall portions **(16*a*) covering said spaces between said lugs (17), said cover wall portions (16*a*) extending outwardly from the opposite ends of said caseband-bezel unit (10) and side walls (10*a*), the middle (14) presenting a groove (24), said caseband also comprising an annular inner shoulder portion surrounded by a rim portion (21) integral with the middle (14), for receiving a dial (19), providing metal cap means (20) having a top opening surrounded by the top edge (32) of said cap, side portions (20*a*) and end portions (20*b*) overlaying side walls (10*a*) and cover wall portions (16*a*) of said caseband respectively, placing said metal cap means (20) on said caseband-bezel unit (10) in order to match the shape of said caseband-bezel unit (10), providing a glass (18) of a material that can be bonded to the material of the caseband-bezel unit (10), said glass comprising a peripherical axially extending lip (22), an outer heel (28) extending radially towards its periphery, and an inner heel (29), placing said glass (18) on said caseband-bezel unit (10) covered with said cap means (20) such that the lip (22) is engaged in the groove (24) of said caseband-bezel unit (10), the heel (28) defines with the bezel (16) a groove (30) in which the top edge (32) of said cap (20) is held and sandwiched for positioning said cap axially and radially, and the inner heel (29) defines with the shoulder portion and said rim (21) another groove (23) in which the outer edge (25) of the dial (19) is held, bonding said glass (18) to the caseband-bezel unit (10) by ultrasonic energy to form an annulus (26), made up of a blend of the materials forming said glass (18) and said unit (10)**.

* * * * *